US007074087B2

(12) United States Patent
Szczesny et al.

(10) Patent No.: US 7,074,087 B2
(45) Date of Patent: Jul. 11, 2006

(54) CABLE CONNECTOR SYSTEM FOR SHIELDED CABLE

(75) Inventors: David S. Szczesny, Hershey, PA (US); Bernadette M. Flinchbaugh, York Haven, PA (US); Steven D. Dunwoody, Middletown, PA (US); Michael Fogg, Harrisburg, PA (US); Charles Adams, Harrisburg, PA (US); Julia Lachman, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/987,799

(22) Filed: Nov. 12, 2004

(65) Prior Publication Data

US 2006/0105632 A1 May 18, 2006

(51) Int. Cl.
*H01R 13/648* (2006.01)

(52) U.S. Cl. ..... 439/610; 439/98

(58) Field of Classification Search ..... 439/610, 439/99, 98

See application file for complete search history.

(56) References Cited

U.S. PATENT DOCUMENTS

| | | | | |
|---|---|---|---|---|
| 3,963,291 | A | 6/1976 | Maloof | |
| 4,106,831 | A | 8/1978 | Albrecht | |
| 4,272,148 | A * | 6/1981 | Knack, Jr. | 439/455 |
| 4,634,208 | A * | 1/1987 | Hall et al. | 439/610 |
| 4,808,128 | A * | 2/1989 | Werth | 439/610 |
| 4,960,392 | A * | 10/1990 | Dickie | 439/620 |
| 5,310,359 | A * | 5/1994 | Chadbourne et al. | 439/462 |
| 5,380,219 | A | 1/1995 | Klier | |
| 5,735,707 | A | 4/1998 | O'Groske et al. | |
| 5,882,226 | A * | 3/1999 | Bell et al. | 439/582 |
| 5,895,292 | A * | 4/1999 | Affeltranger | 439/610 |
| 5,938,475 | A * | 8/1999 | Penner et al. | 439/610 |
| 5,962,812 | A * | 10/1999 | Miyazaki | 174/78 |
| 6,053,749 | A * | 4/2000 | Masuda et al. | 439/98 |
| 6,641,429 | B1 * | 11/2003 | Wu | 439/465 |
| 6,648,683 | B1 * | 11/2003 | Youtsey | 439/578 |

* cited by examiner

*Primary Examiner*—Gary F. Paumen

(57) ABSTRACT

A cable connector assembly includes a ferrule assembly configured for attachment to a cable braid, and a resilient contact element surrounding an end of the ferrule assembly. A retaining band clamps the cable braid to the ferrule assembly. A conductive shell is configured to compress the resilient contact element.

19 Claims, 7 Drawing Sheets

CABLE CONNECTOR SYSTEM FOR SHIELDED CABLE

BACKGROUND OF THE INVENTION

This invention relates generally to electrical connectors, and more specifically to cable connector assemblies for use with shielded cables having metallized braids.

Some electrical systems include shielded cable assemblies for transmitting electrical signals. Conductive metallized braids are coupled to the cable and surround the signal conductors in the cable for shielding purposes, and the metallized braids are connected to shielding features of connectors and components which ultimately provide a conductive path to ground. The metal braids of the cables, however, tend to complicate termination of the cables to connectors, and also complicate interconnection of the cables with other electrical components.

In systems of this type, connectors for shielded cables often include conductive metal shells, and some conventional metal shells include integral ferrule surfaces formed therewith which aid in connecting the cable braid to the shells. The cable braid is extended over the ferrule surfaces of the shells, and outer ferrule elements are attached over and crimped to the cable braid, thereby trapping the cable braid between the ferrule surfaces of the shell and the outer ferrule elements. While a satisfactory mechanical and electrical connection between the cable braid and the shells may result in such a construction, the ferrule surfaces of the shells are vulnerable to being damaged during assembly of the connector. Damage to the ferrule surfaces can compromise the performance of the cable connector and present reliability and performance issues, or cause the cable connector to be scrapped altogether, thereby reducing manufacturing efficiency and raising the costs of production.

Further, some electrical cables include a large conduit with a large number of conductors therein, and terminating the cable conductors to a connector and successfully connecting the cable braid to the shell is difficult. For example, at least one known connector is configured for attachment to as many as forty cable conductors. In such circumstances, the cable can become difficult to handle when the cable connector is installed, thereby increasing the risk that the ferrules will be damaged as the connector assembly is assembled.

BRIEF DESCRIPTION OF THE INVENTION

According to an exemplary embodiment, a cable connector assembly comprises a ferrule assembly configured for attachment to a cable braid, and a resilient contact element surrounding an end of the ferrule assembly.

Optionally, a retaining band at one end of the ferrule assembly clamps the ferrule assembly to the cable braid. A radial groove may be provided in the cable assembly, and the resilient contact element is located in the radial groove. The ferrule assembly may be fixedly mounted to the conductive shell to prevent rotation of the ferrule assembly with respect to the shell, and the ferrule assembly may comprise a 90° bend. A conductive shell may be provided, and the conductive shell may be configured to compress the resilient contact element. The resilient contact element may comprise a canted coil spring.

According to another exemplary embodiment, a cable connector assembly comprises a conductive shell, and a ferrule assembly configured for attachment to a cable braid. The ferrule assembly extends from the conductive shell, and a compressible contact element encircles the ferrule assembly within the conductive shell. The contact element establishes an electrical connection to the shell when compressed.

According to still another exemplary embodiment, a cable connector assembly comprises first and second conductive shell elements, and each of the first and second conductive shells comprise an arcuate slot having a curved engagement surface. A ferrule assembly comprises first and second ferrule elements configured to attach to a cable braid, and the ferrule assembly comprises a radial groove. A resilient contact element extends circumferentially on the ferrule assembly within the radial groove, and the first and second shell elements compress the resilient contact element when the contact element is inserted into the slot and when the first and second shell elements are fastened together.

DETAILED DESCRIPTION OF THE INVENTION

Figure 1:
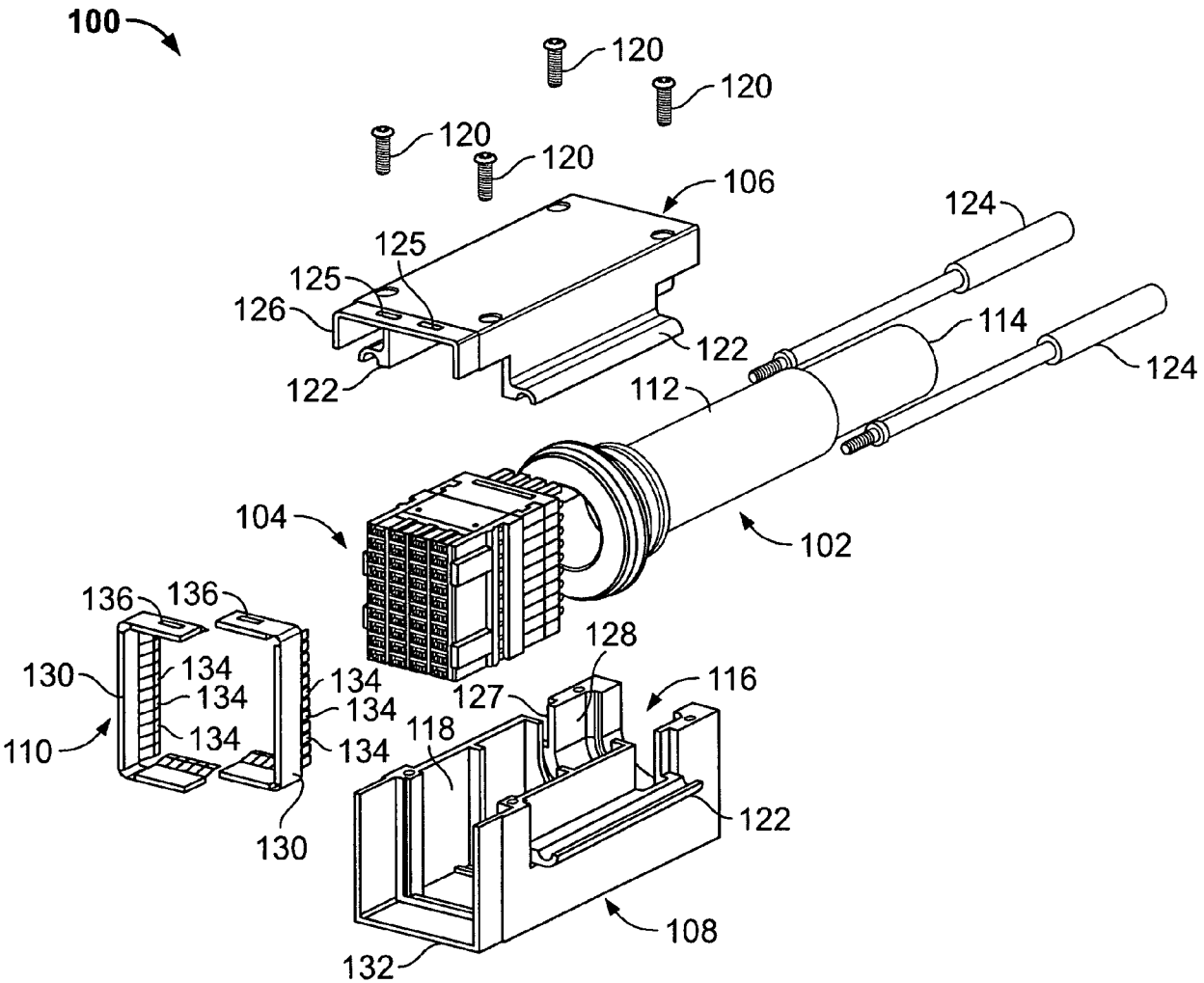
FIG. 1 is an exploded view of a cable connector assembly formed in accordance with an exemplary embodiment of the invention.

FIG. 1 is an exploded view of a cable connector assembly 100 formed in accordance with an exemplary embodiment of the present invention. The connector assembly 100 is particularly useful with shielded cables as explained below, and may be installed to shielded cables in a direct and reliable manner which avoids the aforementioned difficulties and disadvantages of known cable connectors when used with shielded cables.

As shown in FIG. 1, in an illustrative embodiment the cable connector assembly 100 includes an inner ferrule assembly 102, a cable connector 104, upper and lower shells 106 and 108, and a ground shield assembly 110. The upper and lower shells 106, 108 receive the inner ferrule assembly 102 and the cable connector 104, and the ferrule assembly 102 establishes a reliable electrical connection to the upper and lower shells 106, 108 while alleviating manufacturing and assembly difficulties of known cable connectors. Specifically, the ferrule assembly 102 assures adequate electrical contact with the upper and lower shells 106 and 108, and may be reliably manufactured and assembled in a straightforward and cost effective manner without damage to the components of the assembly.

The ferrule assembly 102 is attached to a conductive metallized braid 112 of a cable 114 in the manner explained below. The ferrule assembly 102 is received within a first compartment 116 defined by the upper and lower shells 106, 108 when the cable connector assembly 100 is assembled. The cable connector 104 is electrically connected or terminated to conductors in the cable 114, and the cable connector 104 is received in a second compartment 118 defined by the upper and lower shells 106, 108 when the connector assembly 100 is assembled.

In an exemplary embodiment, the cable connector 104 is a known connector which is mechanically and electrically connected or terminated to conductors in the cable 114 in a known manner. As such, and in an exemplary embodiment, the cable connector 114 provides interconnection of high-speed, low-voltage, differential signals between the cable 114 and a backplane connector (not shown in FIG. 1) mounted in, for example, a computer server system. In one such embodiment, the cable connector 104 is as a Z-PACK Hm-Zd cable connector that is commercially available from Tyco Electronics Corporation of Harrisburg, Pa. Other cable connectors may be utilized, however, in alternative embodiments, provided that they are compatible the backplane or mating connector of the computer system.

In an exemplary embodiment, each of the upper and lower shells 106, 108 are fabricated from a conductive material, such as die cast metal, and the shells 106 and 108 form a protective enclosure about the ferrule assembly 102 and the cable connector 104 when the shells 106 and 108 are coupled to one another. The upper and lower shells 106 and 108 are generally rectangular in shape and are sized and dimensioned to securely receive and retain the ferrule assembly 102 and the connector 104. The upper and lower shells 106 and 108 are fitted over one another and mechanically connected to one another with known fastener elements 120, such as screws or rivets. The upper and lower shells 106, 108 are formed with mounting flanges 122 which receive mounting fasteners 124, such as jack screws shown in FIG. 1. The cable connector 100 can be securely mated, via the mounting fasteners 124, to a header assembly (described below) that is mounted to, for example, a frame of a computer chassis.

The upper shield 106 includes shield retaining projections 125 adjacent a forward end 126 thereof. Each of the upper and lower shells 106, 108 include a curved or arcuate slot 127 which accommodates a portion of the ferrule assembly 102. The first compartment 116 of the upper and lower shells 106, 108 includes a rounded engagement surface 128 which supports and compresses an outer surface of the ferrule assembly 102 as explained below.

The ground shield assembly 110 includes U-shaped frame elements 130 that are dimensioned to be attached to and substantially surround the forward end 126 of the upper shell 106 and a forward end 132 of the lower shell 108. Each of the frame elements 130 includes grounding fingers or tabs 134 which extend inwardly into the second compartment 118 of the upper and lower shells 106,108 to contact the outer surfaces of a header shield 206 (described below in relation to FIGS. 5 and 6). Each of the frame elements 130 also includes a retention aperture 136 which cooperates with the retention projections 125 of the upper shell 106 to mechanically connect the frame elements 130 to the upper and lower shells 106, 108.

Figure 2:
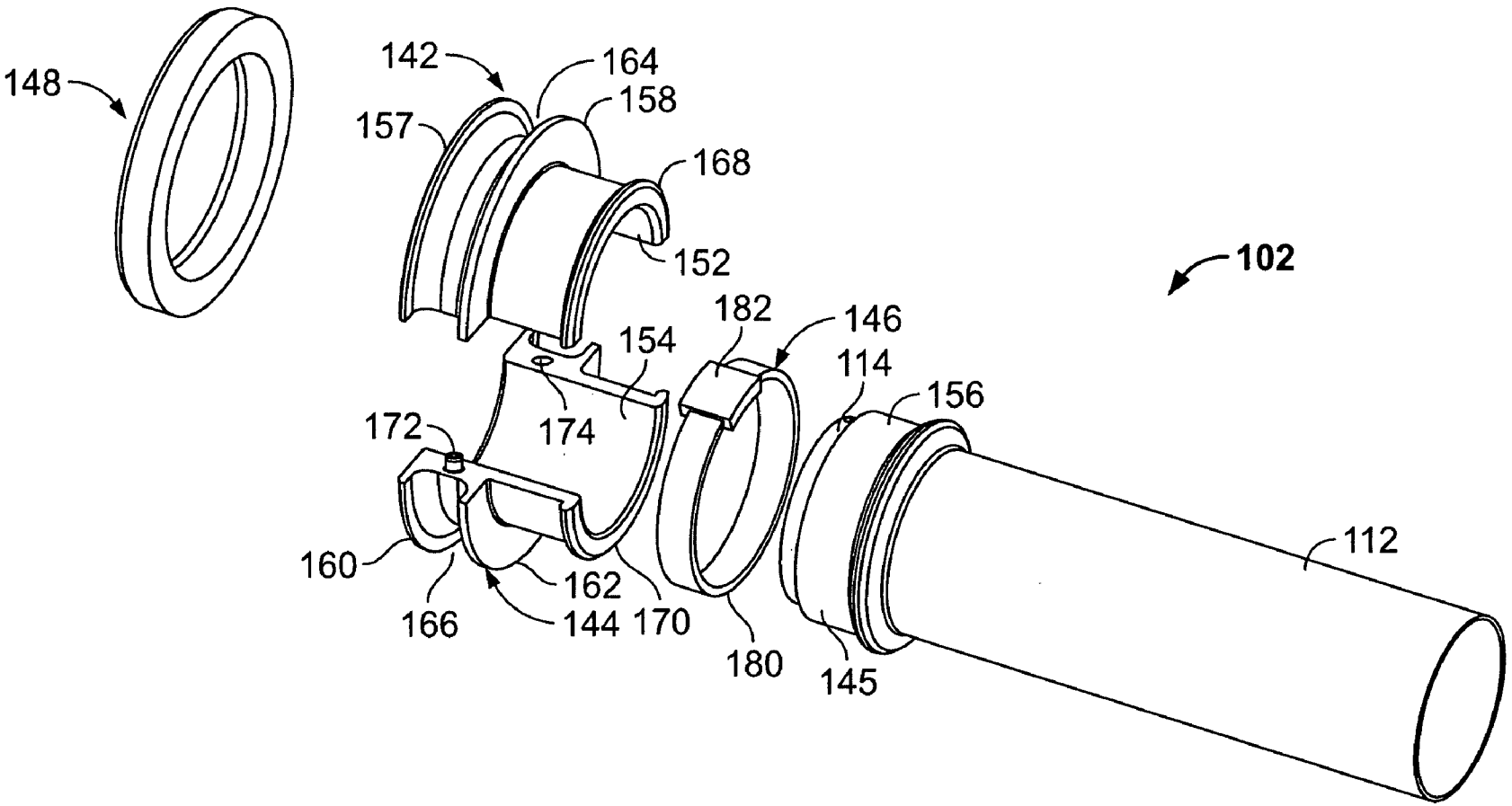
FIG. 2 is an exploded view of the cable ferrule assembly shown in FIG. 1.
Figure 3:
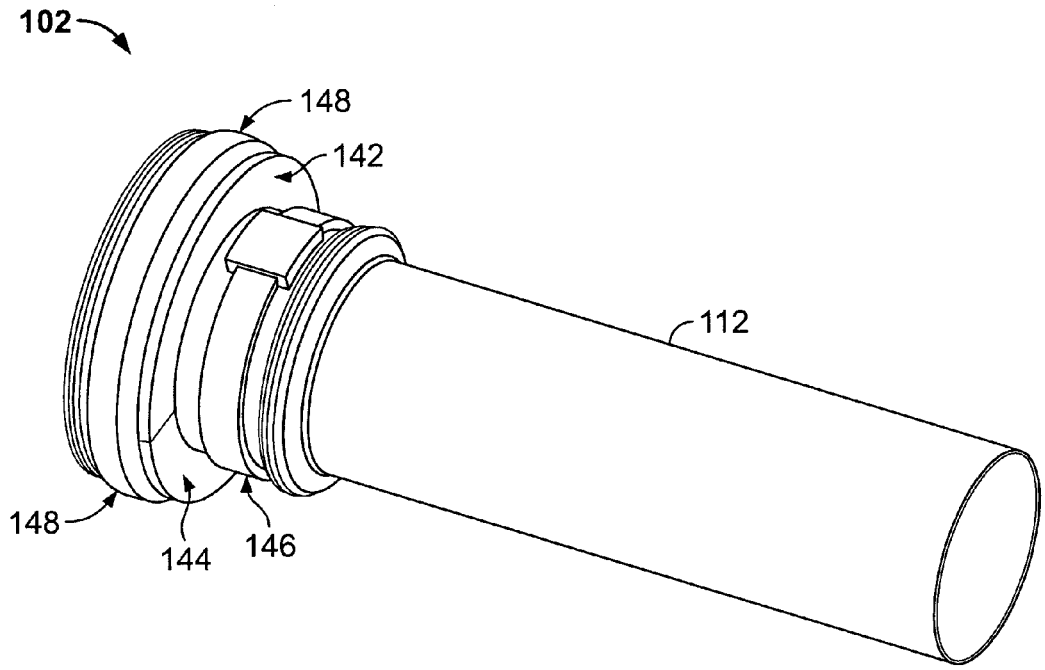
FIG. 3 is an assembly view of the cable ferrule assembly shown in FIG. 2.

FIGS. 2 and 3 are exploded and assembled views, respectively, of the ferrule assembly 102. The ferrule assembly 102 includes the cable braid 112, first and second ferrule elements 142 and 144, a retaining band 146, and a resilient contact element 148.

The cable braid 112 is substantially cylindrical as shown in FIGS. 2 and 3, is externally applied to the cable in a known manner and surrounds inner conductors in the cable. The ferrule elements 142 and 144 each include respective semi-cylindrical inner surfaces 152 and 154 that are fitted over a forward end 156 of the cable conductors 114, and the inner surfaces 152, 154 of the ferrule elements 142, 144 engage the outer surfaces of the conductors. The ferrule elements 142 and 144 further include first and second retaining rims 157, 158 and 160, 162, respectively, which extend radially outwardly from the inner surfaces 152 and 154 and define respective grooves 164, 166 therebetween. The groove 164, 166 extend radially around the circumference of the outer surface of the ferrule elements 142 and 144.

A retaining lip 170 extends outwardly from the respective inner surfaces 152 and 154 at a distance from the radial grooves 164 and 166 of the respective ferrule elements 142 and 144. The ferrule elements 142 and 144 are separately formed and fabricated from one another in a known die cast metal process. The ferrule elements 142, and 144 are essentially mirror images of one another, and are snap fit to one another over the end 156 of the cable conductors 114 as shown in FIG. 3. Snap fit engagement of the ferrule elements 142 and 144 is provided via mounting pegs 172 and apertures 174 formed into the ferrule elements 142 and 144. The ferrule elements 142, 144 are received over the outer surface 145 of the cable conductors and do not contact an inner surface of the cable conductors during installation. The ferrule elements 142, 144 are therefore rather easily assembled in comparison to convention connector assemblies.

Once the ferrule elements 142, 144 are in place on the cable, the braid 112 may be drawn over the ferrule elements up to retaining rims 162, 158 and be clamped to the ferrule assembly in a straightforward manner with the retaining band 146. The retaining band 146 in an exemplary embodiment is a known clamp element having an adjustable stainless steel ring 180 and buckle 182 which compresses the end 156 of the cable braid 112 onto the ferrule elements 142 and 144. One such retaining band is a commercially available BAND-IT clamping system of Band-It-Idex, Inc. of Denver, Colo. The ring 180 is extended over cable braid 112 and the ferrule elements 142, 144 between the respective retaining lips 168, 170 and the rims 158, 162. Once located over the ferrule elements 142 and 144, the ring 180 is tightened over the ferrule elements 142, 144 and the buckle 182 latches the ring 180 in place to attach the cable braid 112 to the ferrule elements 142,144.

The resilient contact element 148 is toroid shaped and is dimensioned so that it may be received in the radial grooves 164, 166 of the ferrule elements 142 and 144. As shown in FIG. 3, the contact element 148 extends circumferentially and encircles one end of the ferrule elements 140, 142 when located in the radial grooves 164, 166. The contact element 148 protrudes outwardly from the grooves 164, 166 such that the contact element 148 is in contact with and compressed by the rounded engagement surfaces 128 of the upper and lower shells 106, 108 (FIG. 1) when the shells 106, 108 are coupled to one another.

The resilient contact element 148 in an exemplary embodiment is a canted-coil spring having inclined or canted coils that deflect independently when compressed. As such, the entire spring element responds wherever any portion of a coil is deflected by the upper and lower shells 106, 108, thereby permitting uniform loading at each contact point. Additionally, the canted coil spring presents a large number of contact points with the upper and lower shells 106, 108 (FIG. 1) when the contact element 148 is received in the slots 127 (FIG. 1) and in abutting engagement contact with the engagement surface 128 (FIG. 1). Such canted springs are commercially available from, for example, Bal Seal Engineering Co., Inc. of Foothill Ranch, Calif. It is recognized, however, that other contacts elements may be employed in alternative embodiments.

When compressed, the resilient contact element 148 maintains secure mechanical and electrical engagement between the upper and lower shells 106 and 108 and the ferrule elements 142 and 144, while the retaining band 146 maintains secure mechanical and electrical engagement between the ferrule elements 142,144 and the cable braid 112. The ferrule elements 142, 144, and the resilient contact element 148 permit some flexibility in assembling the connector 100, particularly with regard to terminating the cable conductors to the connector 104 (FIG. 1). More specifically, and unlike known connector assemblies, the cable braid 112 may be connected to the upper and lower shells 106, 108 after the cable is terminated to the connector 104, and ferrule surfaces in the conductive shells are unnecessary to establish an electrical connection to the braid 112. Further, because the ferrule elements 142, 144 are installed over the exterior of the cable conductors 114, they may be installed rather easily with little risk of damage. The contact element 148 is easily installed to the ferrule elements 142, 144 and provides reliable electrical connection to the upper and lower shells 106, 108 when the upper and lower shells 106, 108 are joined without being separately connected to the shells 106, 108 prior to coupling the shells together.

Figure 4:
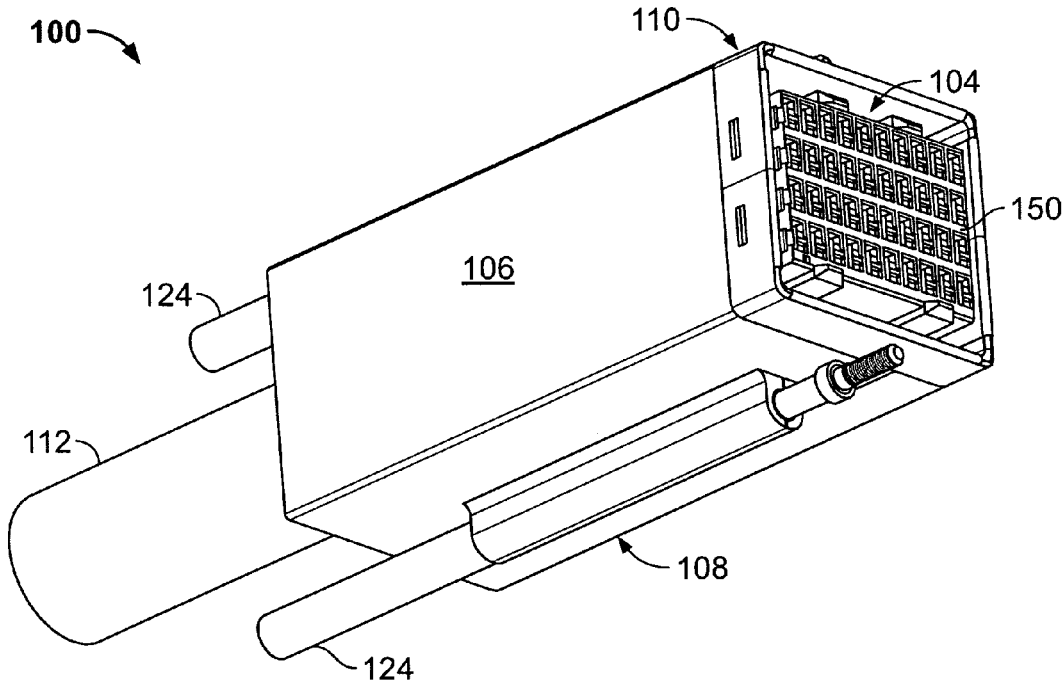
FIG. 4 is an assembled view of the cable connector assembly shown in FIG. 1.

FIG. 4 illustrates the completed cable connector assembly 100 with the upper shell 106 coupled to the lower shell 108 and enclosing the ferrule elements 142 and 144 (FIGS. 2 and 3) and the cable connector 104. The ground shield assembly 110 is attached the upper and lower shells 106, 108 adjacent a connector face 150 of the connector 104 which receives mating contacts (not shown in FIG. 4) of a header assembly (described below). The cable braid 112 extends from the upper and lower shells 106, 108 at an end thereof opposite the connector face 150. The mounting fasteners 124 extend alongside and partly through the upper and lower shells 106 and 108 and may be received in mounting apertures of, for example, a computer chassis frame near the mating header assembly. While jack screws are illustrated in FIG. 4, it is recognized that other types of mounting fasteners 124 may be employed in other embodiments to mount the connector assembly 102 in a predetermined location.

Figure 5:
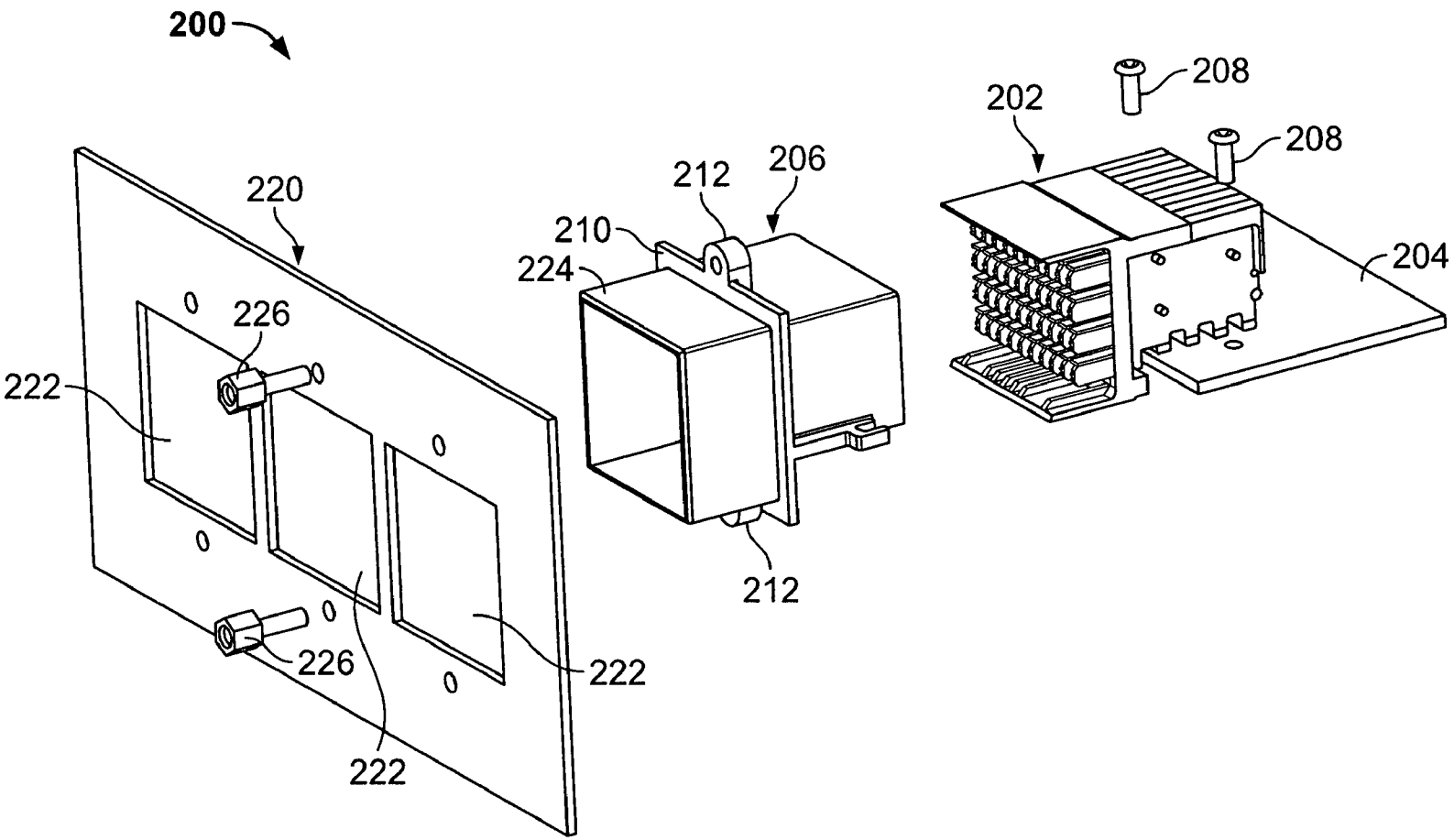
FIG. 5 is an exploded view of a header assembly that may be used with the cable connector assembly shown in FIGS. 1–4.
Figure 6:
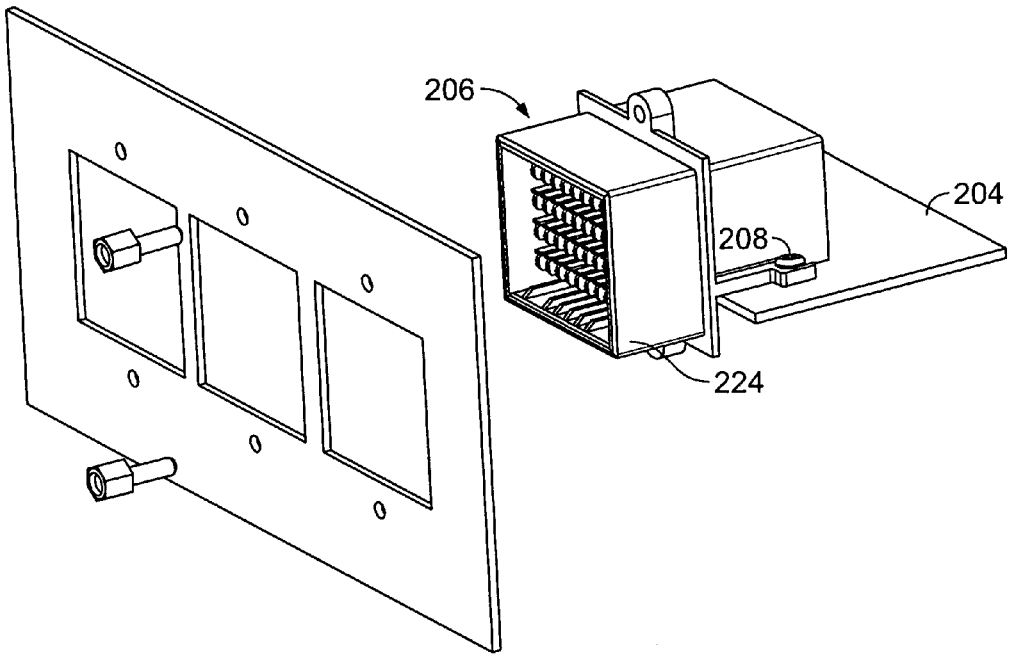
FIG. 6 is a partly assembled view of the header assembly shown in FIG. 5.
Figure 7:
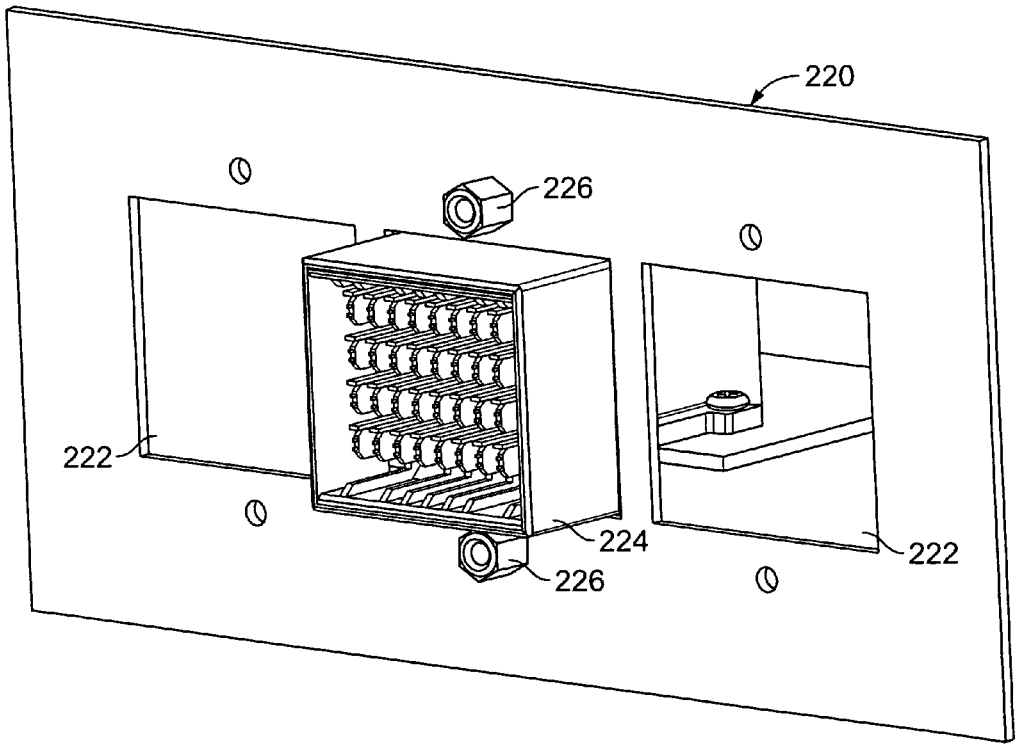
FIG. 7 is an assembled view of the header assembly shown in FIGS. 5 and 6.

FIGS. 5–7 illustrates a header assembly 200 which may be used with the cable connector assembly 100 shown in FIGS. 1–4. The header assembly 200 includes a known backplane connector 202 that is connected to a printed circuit board 204 in a known manner. In an exemplary embodiment, the backplane connector 204 provides interconnection of high-speed, low-voltage, differential signals between the printed circuit board 204 and the cable connector assembly 100. In one such embodiment, the backplane connector 204 is as a Z-PACK Hm-Zd right angle backplane connector which is commercially available from Tyco Electronics Corporation of Harrisburg, Pa. Other cable connectors which are compatible with the cable connector assembly 100 may be utilized, however, in alternative embodiments.

A header shield 206 substantially surrounds the backplane connector 202 and is attached to printed circuit board 204 with fasteners 208 as shown in FIG. 6. The header shield 206 includes a mounting rim 210 having mounting tabs 212 with apertures therethrough. The shield 206 may be fabricated from, for example, die cast metal in a known manner. While female screw locks are illustrated as the fasteners 208, it is appreciated that other fasteners may be employed in alternative embodiments.

A connector interface panel 220 includes a number of cutouts or apertures 222 which are dimensioned to receive a front shroud 224 of the header shield 206 as shown in FIG. 7. Fasteners 226 are inserted through the panel 220 above and below the front shroud 224, and the fasteners 226 engage the mounting tabs 212 to mechanically connect the header assembly 200 to the panel 220. In the illustrated embodiment, the panel 220 includes three cutouts 222 and may therefore accommodate three header assemblies 200 in a side-by-side configuration. It is recognized, however, that the panel 220 may include greater or less than three cutouts 222 in alternative embodiments to accommodate different numbers of header assemblies 200.

The panel 220 may be mounted to, for example, a chassis (not shown) of a computer system and serve as an input/output port for communicating with circuit boards in the chassis via header assemblies 200. Once the header assembly 200 is mounted to the panel 220, the cable connector assembly 100 (FIGS. 1–4) may be plugged into the shroud 224 to mate the cable connector 104 (FIGS. 1 and 4) to the header assembly 200 (FIGS. 5–7). The mounting fasteners 124, such as the jack screws shown in FIGS. 1 and 4 may be connected to the female fasteners 226 extending above and below the shroud 224 to securely latch or retain the cable connector assembly 100 to the panel 220 in electrical engagement with the header assembly 200.

Figure 8:
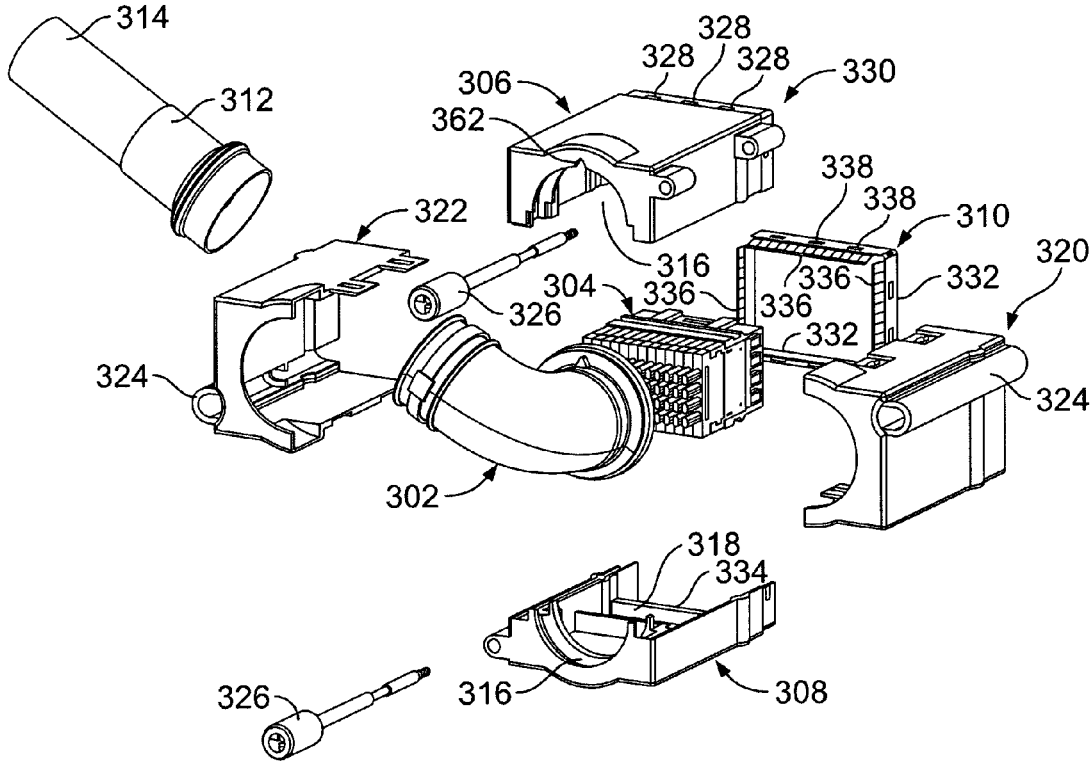
FIG. 8 is an exploded view of another exemplary embodiment of a cable connector assembly.

FIG. 8 is a perspective view of another embodiment of a cable connector assembly 300 which may be used with, for example, the header assembly 200 (shown in FIGS. 5–7).

The cable connector assembly 300 includes an inner ferrule assembly 302, a cable connector 304, upper and lower shells 306 and 308 which receive the inner ferrule assembly 302 and the cable connector 304, and a ground shield assembly 310.

The ferrule assembly 302 is attached a conductive metallized braid 312 of a cable 314, and the ferrule assembly 302 is received within a first compartment 316 defined by the upper and lower shells 306, 308. The cable connector 304 is electrically connected to conductors in the cable, and the cable connector 304 is received in a second compartment 318 defined by the upper and lower shells 306, 308. The ferrule assembly 302 includes approximately a 90° bend in an illustrative embodiment, although the ferrule assembly may include a bend of greater or less than 90° in an alternative embodiment.

In an exemplary embodiment, the cable connector 304 is a known connector which is mechanically and electrically connected or terminated to conductors in the cable. As such, and in an exemplary embodiment, the cable connector 304 provides interconnection of high-speed, low-voltage, differential signals between the cable and a backplane connector, such as the connector 202 (FIG. 5) of, for example a computer server system. In one such embodiment, the cable connector 304 is as a Z-PACK Hm-Zd cable connector which is commercially available from Tyco Electronics Corporation of Harrisburg, Pa. Other cable connectors which are compatible with a backplane connector may be utilized, however, in alternative embodiments.

In an exemplary embodiment, each of the upper and lower shells 306, 308 are fabricated from a conductive material, such as die cast metal, and the shells 306, 308 form a protective enclosure about a portion of the ferrule assembly 302 and the cable connector 304 when the shells 306 and 308 are coupled to one another. The upper and lower shells 306, 308 are sized and dimensioned to securely receive and retain the ferrule assembly 302 and the connector 304, and the upper and lower shells 306, 308 are mechanically connected to one another with known fastener elements such as screws or rivets.

The connector assembly 300 further includes side insulating shells 320 and 322 which are fabricated from plastic, for example, and snap together over the upper and lower shells 306 and 308. The side insulating shells 320 and 322 are formed with connector flanges 324 which receive mounting fasteners 326, such as jack screws shown in FIG. 8, so that the cable connector 300 can be securely mated to a header assembly mounted in, for example, a frame of a computer chassis.

The upper shield 306 includes shield retaining projections 328 adjacent a forward end 330 thereof. The ground shield assembly 310 includes L-shaped frame elements 332 which are dimensioned to be attached to and substantially surround the forward end 330 of the upper shell 306 and a forward end 334 of the lower shell 308. Each of the frame elements 332 includes grounding fingers or tabs 334 which contact the outer surfaces of mating header shield (not shown in FIG. 8). Each of the frame elements 332 also includes retention apertures 335 which cooperate with the retention projections 328 of the upper shell 306 to mechanically connect the frame elements 332 to the upper and lower shells 306 and 308.

Figure 9:
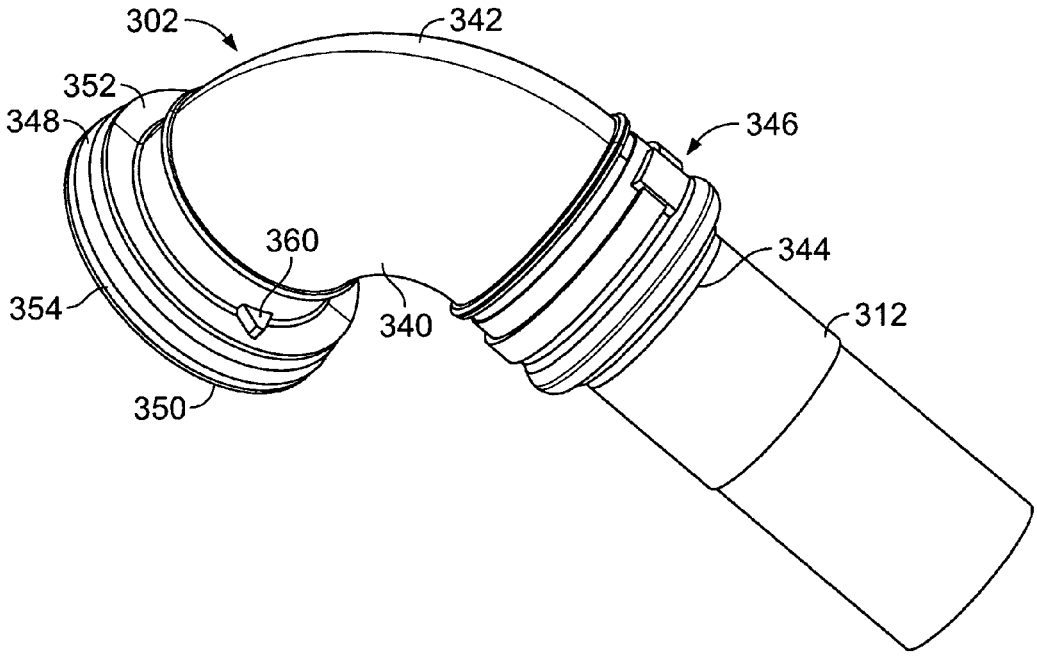
FIG. 9 is a perspective view of the ferrule assembly shown in FIG. 8.

FIG. 9 illustrates the ferrule assembly 302 including a first ferrule element 340 and a second ferrule element 342 which are formed as mirror images of one another and snapped together to define a substantially continuous sleeve which receives the cable braid 312 (FIG. 8) at one end 344. A retaining band clamp 346 is located adjacent the end 344 of the ferrule assembly 302 and is tightened or clamped to the outer surface of the cable braid 312. A resilient contact element 348 extends on the opposite end 350 of the ferrule assembly 302, and the contact element 348 extends between radially projecting rims 352, 354 formed in the ferrule elements 340 and 342. In an illustrative embodiment, the retaining band clamp 346 is BAND-IT clamp as described above, and the contact element 348 is a canted coil spring as described above. Different clamps or fasteners and/or different contact elements may be employed in alternative embodiments, however, as desired.

The ferrule element 340 includes a locating projection 360 adjacent the rim 352 which cooperates with a complementary shaped notch 362 (FIG. 8) in the upper shell 306 to fix the relative orientations of the ferrule assembly 302 and the upper and lower shells 306, 308. When the projection 360 is received in the notch 362, the ferrule assembly 302 is prevented from moving or rotating relative to the upper and lower shells 306, 308 and associated stress on the cable and connector due to relative movement of the cable with respect to the connector 304 is avoided. The locating projection 360 and the notch 362 may be positioned in various locations on the ferrule assembly 302 and the upper shell 306, respectively, to orient and lock the ferrule assembly 302 in different positions relative to the upper and lower shells 306 and 308. Multiple notches 362 may be utilized to enhance tooling flexibility.

Figure 10:
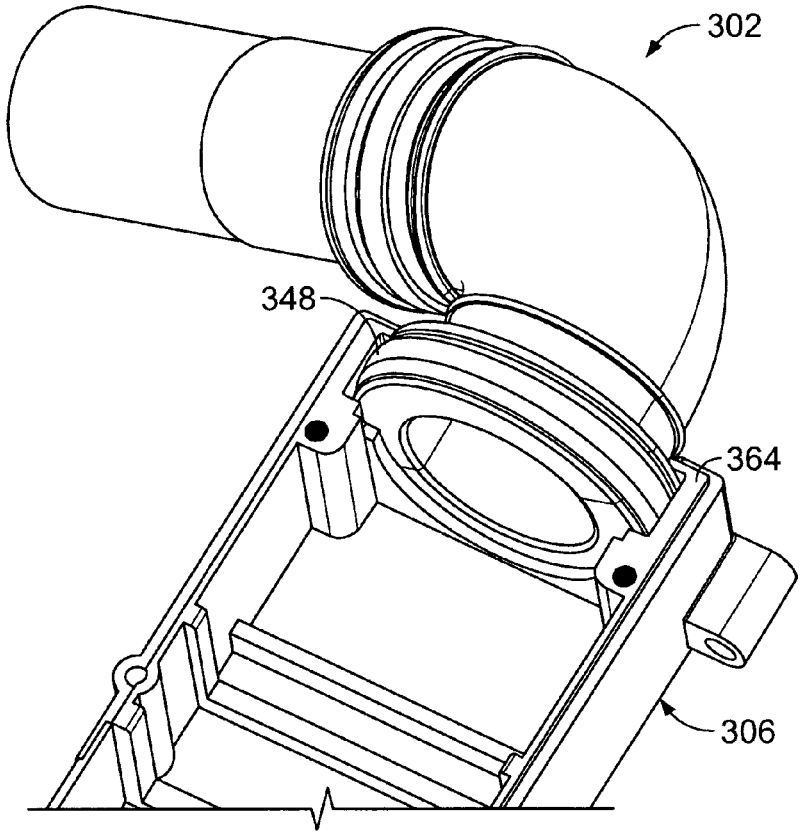
FIG. 10 is a partial assembly view of a portion of the connector shown in FIG. 8.

FIG. 10 illustrates the ferrule assembly 302 resting in one end of the upper shell 306. The resilient contact element 348 is received in a curved or arcuate slot 360 having a curved engagement surface formed in the end of the shell 306, and the contact element continuously engages the curved engagement surface of the slot 360. The lower shell 308 (FIG. 8) includes a similar slot having a curved engagement surface, and when the shells 306, 308 are coupled to one another, the slots of the respective shells compress the contact element 348 to ensure electrical contact between the contact element 348 and the shells 306, 308.

Figure 11:
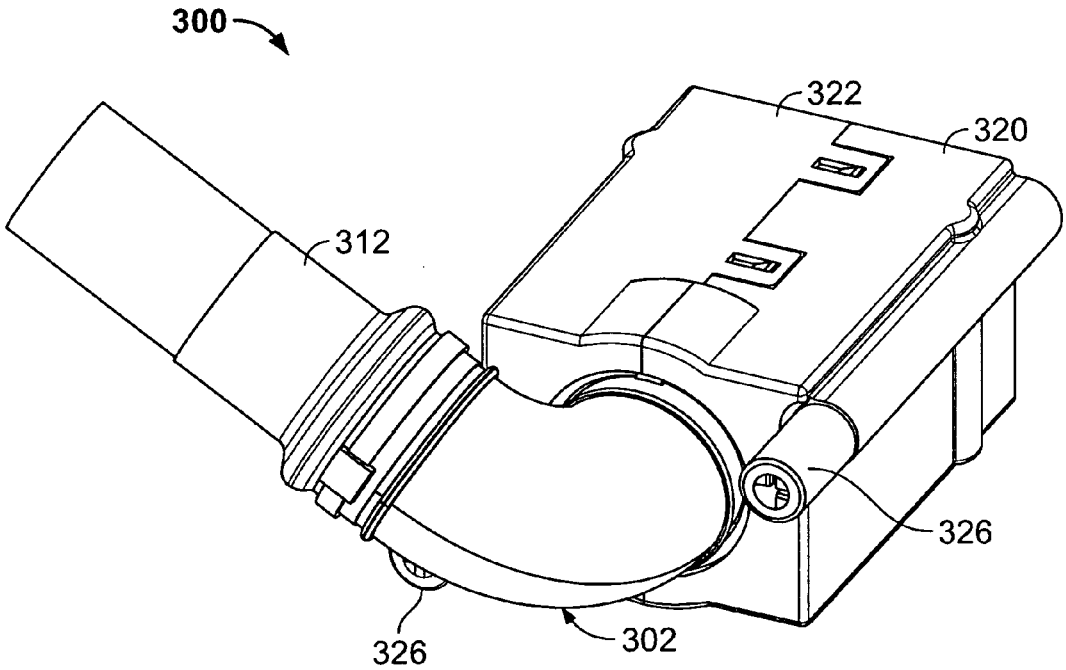
FIG. 11 is an assembled view of the connector shown in FIG. 8.

FIG. 11 illustrates the completed cable connector assembly 300 with the side insulating shells 320, 322 encapsulating and enclosing the upper and lower shells 306 and 308, portions of the ferrule elements 340 and 342 (FIG. 9), and the cable connector 304 (FIG. 8). The ground shield 310 is attached the upper and lower shells 306, 308. The cable braid 312 extends from the ferrule elements 340 and 342 at an end thereof opposite the connector face of the cable connector 304. The mounting fasteners 326 extend alongside the upper and lower shells 306, 308 and partly through the side insulating shells 320 and 322. While jack screws are illustrated in FIG. 4, it is recognized that other types of mounting fasteners 326 may be employed in other embodiments to mount the connector assembly 300 in a predetermined location.

The ferrule assembly 302 and contact element 348 permits a straightforward and lower cost assembly than known cable connectors while avoiding potential damage to the components during assembly. Reliable electrical contact between the cable braid 312 and the ferrule assembly 302 is ensured, and manufacturing and assembly costs are saved.

While the invention has been described in terms of various specific embodiments, those skilled in the art will recognize that the invention can be practiced with modification within the spirit and scope of the claims.

What is claimed is:

1. A cable connector assembly comprising:

a ferrule assembly configured for attachment to a cable braid;

a resilient, compressible contact element surround and in engagement with an end of the ferrule assembly; and a flexible, adjustably tightenable retaining band, separately provided from said ferrule assembly, encircling one end of said ferrule assembly.

2. A cable connector assembly in accordance with claim 1, wherein the ferrule assembly comprises mirror image ferrule elements.

3. A cable connector assembly in accordance with claim 1 wherein said ferrule assembly comprises a radial groove, said resilient contact element located in said radial groove.

4. A cable connector assembly in accordance with claim 1 wherein said ferrule assembly comprises a 90° bend.

5. A cable connector assembly in accordance with claim 1 wherein said cable assembly further comprises a conductive shell, said ferrule assembly being fixedly mounted to said conductive shell to prevent rotation of said ferrule assembly with respect to said shell.

6. A cable connector assembly in accordance with claim 1 wherein said cable assembly further comprises a conductive shell, said conductive shell configured to compress said resilient contact element.

7. A cable connector assembly in accordance with claim 1 wherein said resilient contact element comprises a canted coil spring.

8. A cable connector assembly in accordance with claim 1 wherein said ferrule assembly is fitted under said conductive braid and clamped to said conductive braid.

9. A cable connector assembly in accordance with claim 1 wherein said cable assembly further comprises a conductive shell, said shell comprising an arcuate slot configured to receive said resilient contact element.

10. A cable connector in accordance with claim 1 wherein said resilient contact element is toroid shaped.

11. A cable connector assembly comprising:

a conductive shell;

a ferrule assembly configured for attachment to a cable braid, said ferrule assembly extending from said conductive shell and comprising first and second mirror image ferrule elements;

a compressible contact element encircling said ferrule assembly within said conductive shell, said contact element establishing an electrical connection to said shell when compressed; and further comprising a retaining band attached to one end of said ferrule assembly, said retaining band configured to couple said ferrule assembly to said cable braid.

12. A cable connector assembly in accordance with claim 11 wherein said ferrule assembly comprises a radial groove, said resilient contact extending outwardly from said radial groove.

13. A cable connector assembly in accordance with claim 11 wherein conductive shell and said ferrule assembly are configured to lock said ferrule assembly to said shell to prevent rotation of said ferrule assembly with respect to said shell.

14. A cable connector assembly in accordance with claim 11 wherein said conductive shell is configured to compress said resilient contact element.

15. A cable connector assembly in accordance with claim 11 wherein said resilient contact element comprises a canted coil spring.

16. A cable connector assembly in accordance with claim 11 wherein said shell comprises an arcuate slot configured to receive said resilient contact element.

17. A cable connector in accordance with claim 11 wherein said resilient contact element is toroid shaped.

18. A cable connector assembly comprising:

first and second conductive shell elements, each of said first and second conductive shells comprising an arcuate slot having a curved engagement surface;

a ferrule assembly comprising first and second ferrule elements configured to attach to a cable braid, said ferrule assembly comprising a radial groove; and a resilient contact element extending circumferentially on said ferrule assembly within said radial groove, said first and second shell elements compressing said resilient contact element when said contact element is inserted into said slot and when said first and second shell elements are fastened together.

19. A cable connector in accordance with claim 18 further comprising a retaining band, said retaining band clamping said first and second ferrule elements to said cable braid.

* * * * *